US010022611B2

(12) United States Patent
Oh

(10) Patent No.: US 10,022,611 B2
(45) Date of Patent: Jul. 17, 2018

(54) SAFETY FENCE SUPPORT DEVICE WITH FLEXIBILITY

(71) Applicant: Young Il Oh, Yangsan-si (KR)

(72) Inventor: Young Il Oh, Yangsan-si (KR)

( * ) Notice: Subject to any disclaimer, the term of this patent is extended or adjusted under 35 U.S.C. 154(b) by 421 days.

(21) Appl. No.: 14/925,845

(22) Filed: Oct. 28, 2015

(65) Prior Publication Data

US 2017/0001094 A1 Jan. 5, 2017

(30) Foreign Application Priority Data

Jul. 2, 2015 (KR) ..... 10-2015-0094606

(51) Int. Cl.

| | |
|---|---|
| ***E01F 9/00*** | (2016.01) |
| ***A63B 71/02*** | (2006.01) |
| ***E01F 9/565*** | (2016.01) |
| ***E01F 9/60*** | (2016.01) |
| ***E01F 9/627*** | (2016.01) |
| ***A63B 71/00*** | (2006.01) |
| ***A63C 19/08*** | (2006.01) |
| *A63B 102/24* | (2015.01) |
| *A63B 102/18* | (2015.01) |

(52) U.S. Cl.

CPC ..... *A63B 71/022* (2013.01); *A63B 71/0054* (2013.01); *A63C 19/08* (2013.01); *E01F 9/573* (2016.02); *E01F 9/602* (2016.02); *E01F 9/627* (2016.02); *E01F 9/629* (2016.02); *A63B 2071/0063* (2013.01); *A63B 2102/18* (2015.10); *A63B 2102/24* (2015.10); *A63C 2019/085* (2013.01)

(58) Field of Classification Search

CPC . E01F 9/573; E01F 9/602; E01F 9/627; E01F 9/629; A63B 2071/0072; A63C 2019/085; F16B 7/1481; F16B 7/10; E04H 17/22; Y10T 403/32483

USPC ..... 404/10, 11; 40/608; 256/13.1

See application file for complete search history.

(56) References Cited

U.S. PATENT DOCUMENTS 1,435,363 A * 11/1922 Wood ..... E01F 9/615 116/63 R
1,491,145 A * 4/1924 Lange ..... E01F 9/559 362/145

(Continued)

FOREIGN PATENT DOCUMENTS

DE 3522606 A1 * 3/1986 ..... E01F 9/629
EP 1479826 A2 * 11/2004 ..... E01F 9/629

(Continued)

*Primary Examiner* — Josh Skroupa
*Assistant Examiner* — Matthew R McMahon
(74) *Attorney, Agent, or Firm* — Maschoff Brennan

(57) ABSTRACT

A safety fence support device with flexibility may be provided. More particularly, a safety fence support device with flexibility may be provided which is simply installed on a safety fence used in various sports facilities, e.g., a baseball field, an ice hockey rink, a ski slope, etc., causes the safety fence to be tilted backward even when players playing a game or people enjoying the sports in the sports facilities collide with the safety fence at various angles, thereby preventing injury by mitigating impact applied to a human body through the safety fence, and is used in various sports facilities regardless of the kind of the safety fence by controlling the degree of flexibility for mitigating the impact in accordance with the impact strength.

3 Claims, 11 Drawing Sheets

(56) References Cited

U.S. PATENT DOCUMENTS 1,496,811 A * 6/1924 Lange ..... E01F 9/559 362/153.1
1,599,986 A * 9/1926 Chapel ..... E01F 9/602 248/160
1,647,012 A * 10/1927 Morris ..... E01F 9/602 404/11
2,095,016 A * 10/1937 Waterbor ..... E01F 9/602 404/11
2,165,704 A * 7/1939 Hood ..... E01F 9/627 256/1
2,949,324 A * 8/1960 Birge ..... E01F 9/627 248/576
3,193,230 A * 7/1965 Crankshaw ..... E01F 9/627 248/160
4,067,528 A * 1/1978 Motting ..... B60R 13/005 248/160
4,729,690 A * 3/1988 Lavender ..... E01F 9/638 173/132
5,006,009 A * 4/1991 Griffin ..... E01F 9/629 40/608
5,090,348 A * 2/1992 Hugron ..... E01F 9/638 116/63 P
5,354,144 A * 10/1994 Lizakowski ..... E01F 9/629 40/612
5,624,210 A * 4/1997 Baldwin ..... E04H 12/2215 40/608
6,149,340 A * 11/2000 Pateman ..... E01F 9/627 40/608
6,769,833 B2 * 8/2004 Dicke ..... E01F 9/629 40/608
7,861,434 B2 * 1/2011 Knudsen ..... G01D 1/00 19/244
8,613,412 B1 * 12/2013 Donaldson ..... A45F 3/44 248/156
9,303,374 B2 * 4/2016 Oberkofler ..... E01F 9/673
2002/0026715 A1 3/2002 Bohm-Van Diggelen
2013/0134288 A1 * 5/2013 Webber ..... A47G 29/1216 248/622

FOREIGN PATENT DOCUMENTS

FR 1540430 A * 9/1968 ..... E01F 9/629
JP 2001-510694 A 8/2001
KR 20020043473 A * 6/2002
KR 10-1278537 B1 6/2013

* cited by examiner

SAFETY FENCE SUPPORT DEVICE WITH FLEXIBILITY

BACKGROUND

Field

The present invention relates to a safety fence support device with flexibility, and more particularly to a safety fence support device with flexibility which is simply installed on a safety fence used in various sports facilities, e.g., a baseball field, an ice hockey rink, a ski slope, etc., causes the safety fence to be tilted backward even when players playing a game or people enjoying the sports in the sports facilities collide with the safety fence at various angles, thereby preventing injury by mitigating impact applied to a human body through the safety fence, and is used in various sports facilities regardless of the kind of the safety fence by controlling the degree of flexibility for mitigating the impact in accordance with the impact strength.

Description of the Related Art

In a variety of sports, a safety fence for absorbing impact is installed in the sports facilities in order that players or people enjoying the sports are prevented from being injured by collision with a wall, which is caused by concentration on a game or an inertia force caused by a motion direction.

This safety fence is only a facility for protecting people exercising in the sports facilities. However, a lot of people are injured by collision with the safety fence every year.

For example, regarding an outfield fence of a baseball field, when an outfielder concentrating on a game runs at a full speed to catch a flying ball, he collides frequently with the outfield fence and is severely injured. A player playing the game also worries about injury caused by the collision with the outfield fence, so that performance may be interfered.

Also, with regard to skiing or snowboarding which has high popularity as one of winter sports and is enjoyed by many people, a safety accident occurs frequently every year, in which, when beginners who are inexperienced in skiing deviate from a course of a ski slope and are injured by colliding with a fence installed on the outside of the course while coming down an intermediate course or a higher course.

For the sake of preventing the safety accident caused by the collision with the safety fence, in the past, the impact caused by the collision was mitigated by mainly installing a safety fence formed by using various cushioning materials in a complicated manner.

The safety fence having such a structure has an effect of mitigating the impact to a certain extent when an object collides with the front of the safety fence, that is to say, in a direction perpendicular to the cushion material. However, when an object collides obliquely with the safety fence at a certain inclination angle, the mitigation performance is degraded.

Also, when the cushioning material-made safety fence is installed on the entire outside of sports facilities with a relatively large area, significant economic costs may occur. Therefore, economic efficiency is deteriorated.

Prior Art Document: Korean Registered Patent Publication No. 10-1278537 (Jun. 25, 2013)

SUMMARY

Technical Problem

The present invention is designed to solve the above problems and provides a safety fence support device with flexibility which is simply installed on a safety fence used in various sports facilities, e.g., a baseball park, an ice hockey rink, a ski resort, etc., causes the safety fence to be tilted backward even when players playing a game or people enjoying the sports in the sports facilities collide with the safety fence at various angles, thereby preventing injury by mitigating impact applied to a human body through the safety fence, and is used in various sports facilities regardless of the kind of the safety fence by controlling the degree of flexibility for mitigating the impact in accordance with the impact strength.

Technical Solution

The present invention is designed to achieve the above objectives and provides a safety fence support device with flexibility. The includes: a pipe-shaped upper case which has a closed top surface, a through-hole formed in the center of the closed top surface, a catching portion formed on a circumferential end of the top surface, a pipe-shaped protrusion extending vertically downward at a predetermined distance from the center of the top surface, and an open bottom surface; a cap which opens and closes the upper case; a pipe-shaped lower case which has an open top surface and an open bottom surface, wherein a lower portion of the upper case is inserted within the open top surface; a lower support which is attached to the bottom surface and is fixed to the ground; a first buffer elastic body which is inserted within the upper case, is inserted outside an outer circumferential surface of the protrusion of the upper case, has a top surface contacting the catching portion formed in the upper case, and has a bottom surface contacting a top surface of the lower support; a second buffer elastic body which has a length smaller than that of the first buffer elastic body, is located within the first buffer elastic body, has an upper portion inserted within the protrusion of the upper case, and has a lower portion contacting the top surface of the lower support; a locking washer which is attached to the top surface of the upper case; an adjusting nut which is attached to a top surface of the locking washer and adjusts an initial pressing force of the first buffer elastic body; a screw shaft which has a connecting hook at a lower end thereof, is provided to pass through the centers of the upper case, the locking washer, and the adjusting nut, transfers the adjusting nut, and adjusts and sets the initial pressing force of the first buffer elastic body; and a connection member which is located within the second buffer elastic body, has one end connected to the connecting hook of the screw shaft, and has the other end fixed to a locking pin of a bottom surface of the lower support.

The lower support includes: a lower plate which is attached to the bottom surface of the lower case, has a through-hole formed in the center thereof, wherein the connection member passes through the through-hole, absorbs impact caused by an external force applied to the safety fence at various angles, and is hinge-pivoted together with the upper case, the lower case, and the connection member in a direction of the external force by using a circumferential end thereof as a fulcrum; and a plate receiver which has a through-hole formed in the center thereof, wherein the connection member passes through the through-hole, has a plate receiving recess formed in the center of a top surface thereof, wherein the plate receiving recess receives the lower plate, has a pin groove formed in the center of a bottom surface thereof, wherein the pin groove fixes the connection member, and is fixed to the ground.

The safety fence support device with flexibility further includes an indication scale formed in a longitudinal direction of the upper case on an outer circumferential surface of one side of the upper case which ascends and descends together with the first buffer elastic body, in order that a pressed or expanded length of the first buffer elastic body is visually checked when the first buffer elastic body is pressed or expanded by tightening or loosening the adjusting nut for the purpose of adjusting and setting the initial pressing force of the first buffer elastic body.

Advantageous Effects

The safety fence support device with flexibility according to the embodiment of the present invention is simply installed on wide-ranged safety fences used in various sports facilities regardless of the kind of the safety fence, is easy to maintain and repair due to its simple structure, controls the degree of flexibility for mitigating impact in accordance with the impact strength, and, particularly, effectively mitigates the impact due to an external force applied to the safety fence at various angles.

DETAILED DESCRIPTION

Figure 1:
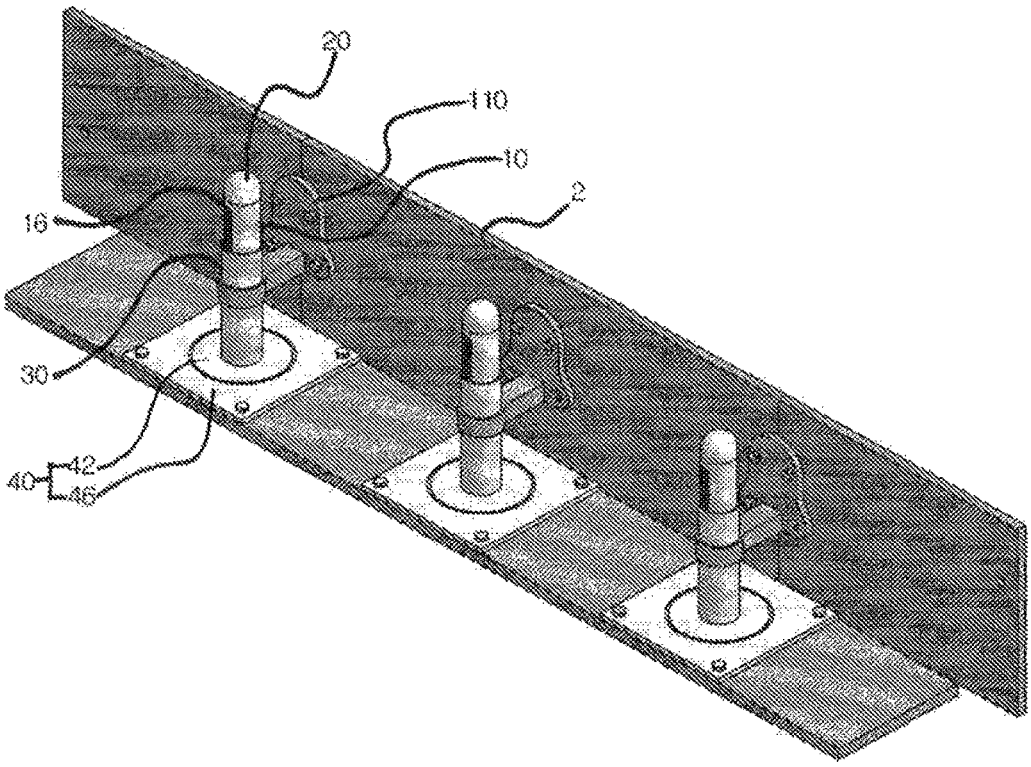
FIG. 1 is a view showing an example in which a safety fence support device with flexibility is stood and installed on a safety fence in accordance with an embodiment of the present invention.

Hereinafter, an exemplary embodiment of the present invention will be described with reference to the accompanying drawings. In the following description and drawings of the present invention, the same reference numerals are used to designate the same or similar components, and the detailed description of known functions and configurations incorporated herein is omitted to avoid making the subject matter of the present invention unclear. Also, in the following description of the embodiment of the present invention, it can be understood that the spirit of the present invention is variously modified and embodied by those skilled in the art without being limited to this.

Figure 2:
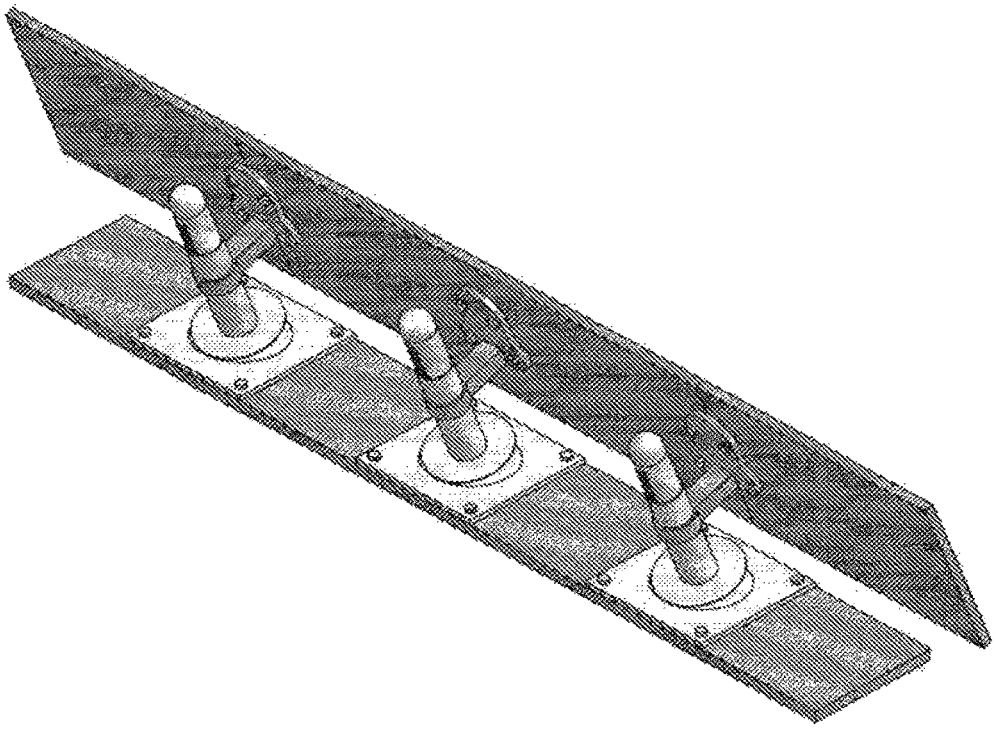
FIG. 2 is a view showing that the safety fence support device with flexibility is installed on a safety fence and is tilted by an external force in accordance with the embodiment of the present invention.
Figure 3:
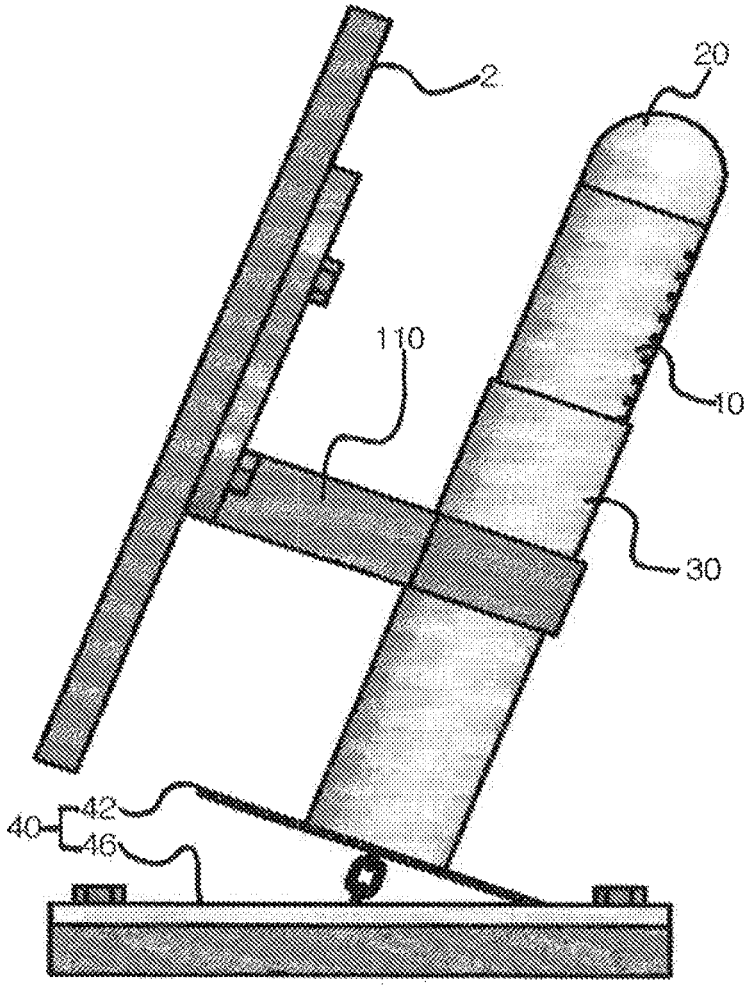
FIG. 3 is a side view of FIG. 2.
Figure 4:
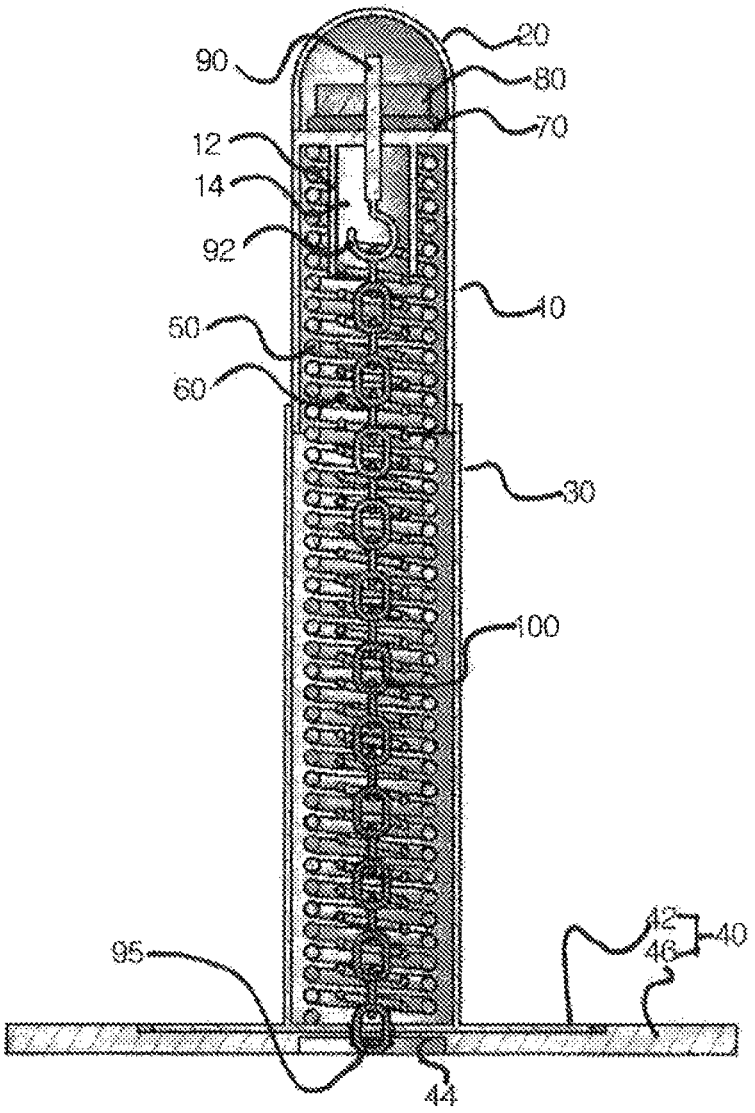
FIG. 4 is a view showing an internal configuration of the safety fence support device with flexibility.
Figure 5:
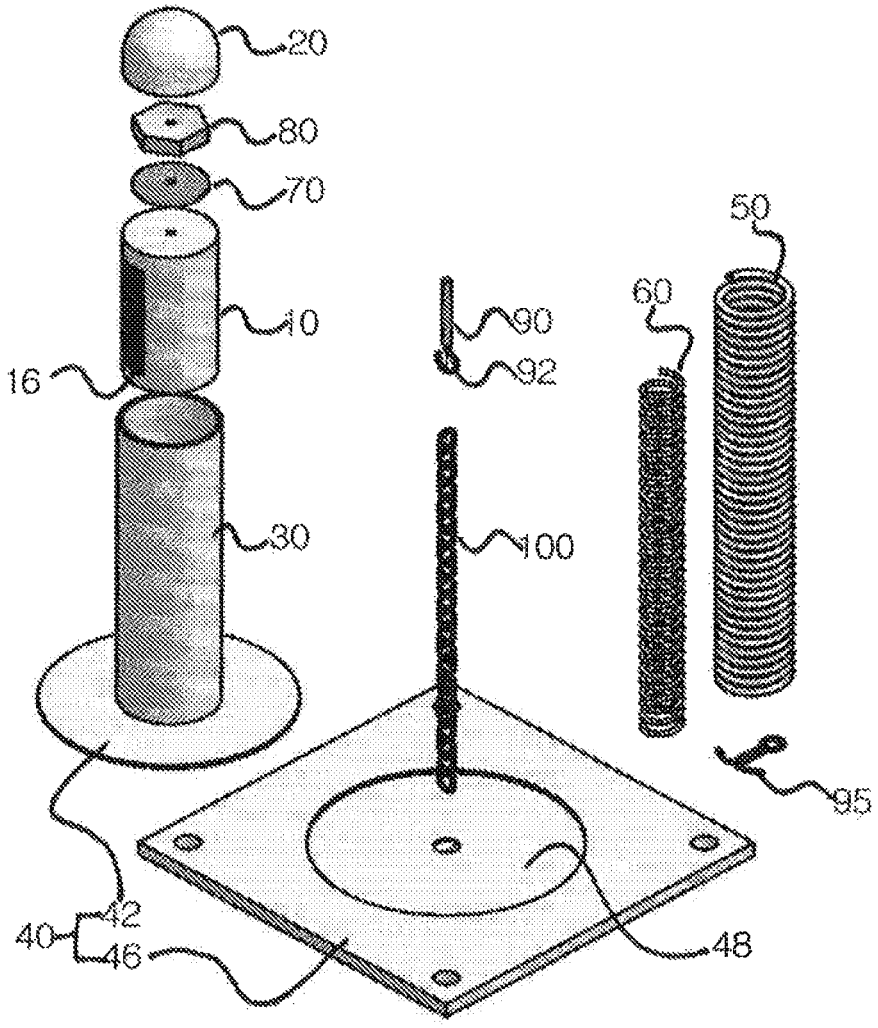
FIG. 5 is an exploded view of the safety fence support device with flexibility.
Figure 6:
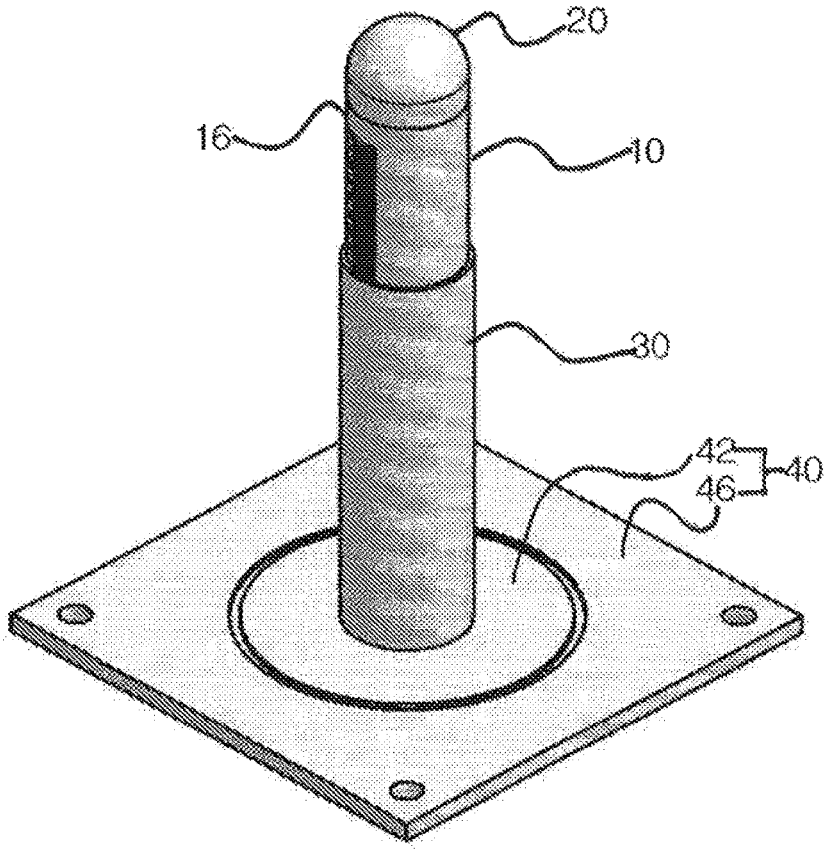
FIG. 6 is a perspective view showing that the safety fence support device with flexibility is stood.
Figure 7:
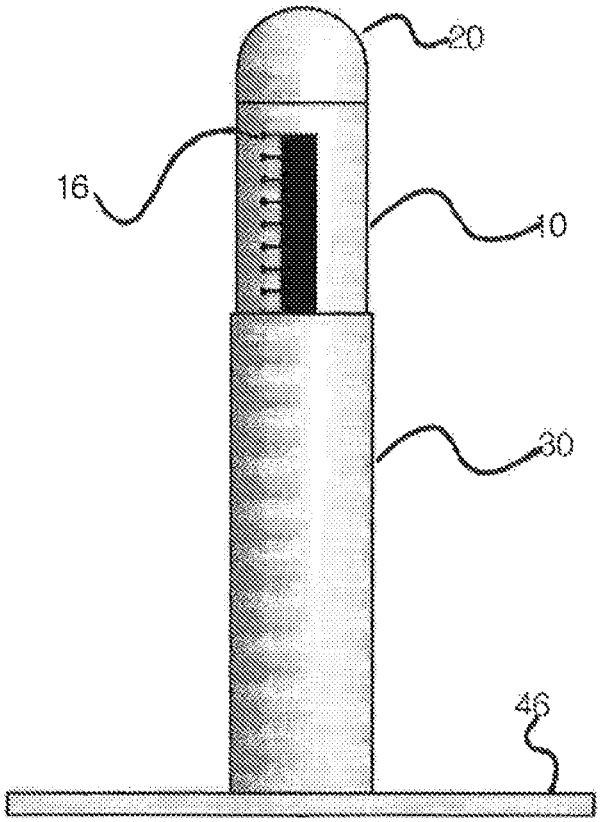
FIG. 7 is a front view of FIG. 6.
Figure 8:
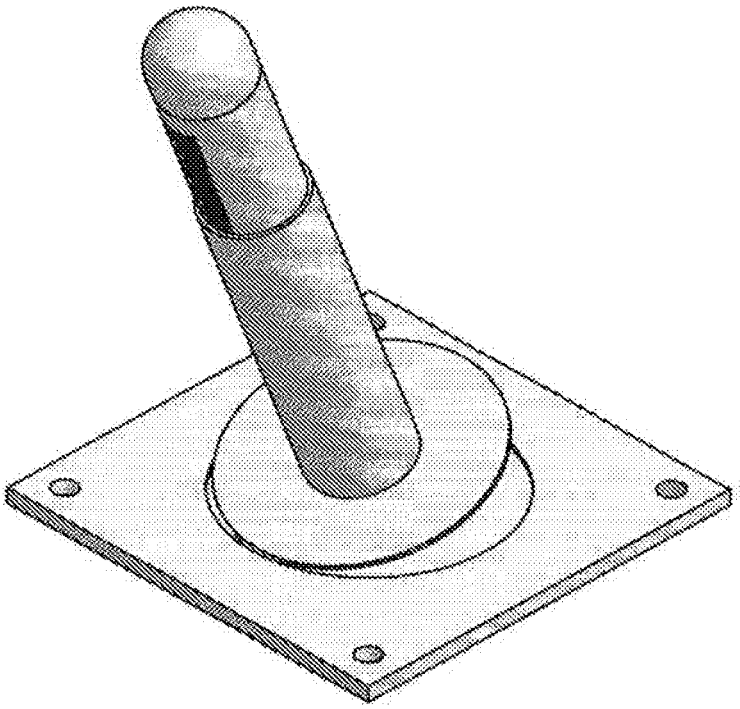
FIG. 8 is a view showing that the safety fence support device with flexibility is hinge-pivoted.
Figure 9:
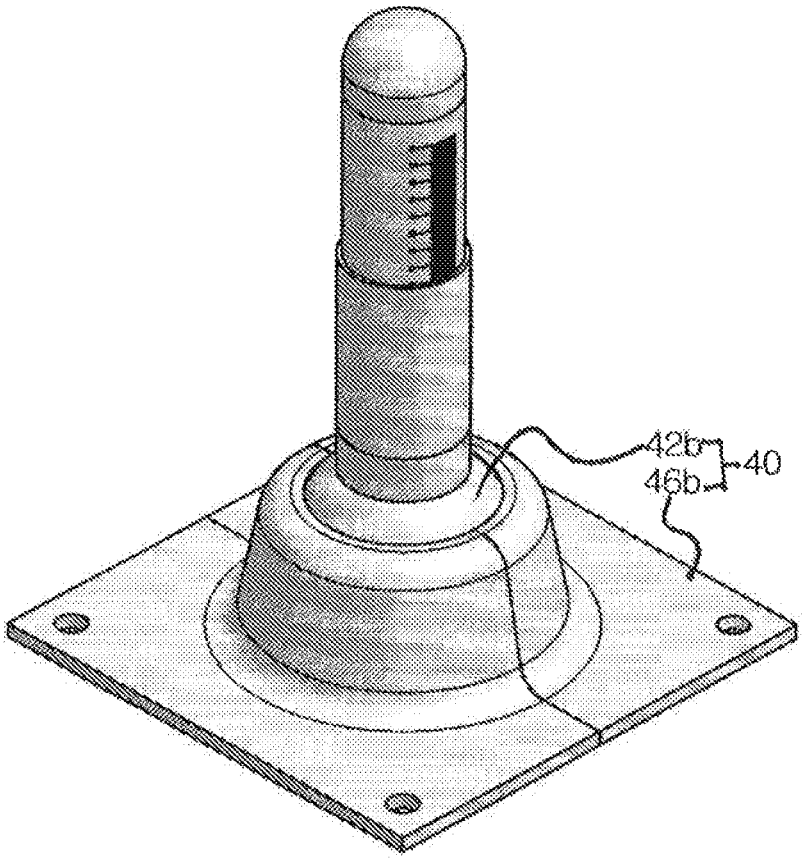
FIG. 9 is a perspective view showing a lower support consisting of a hinge ball and a ball support.
Figure 10:
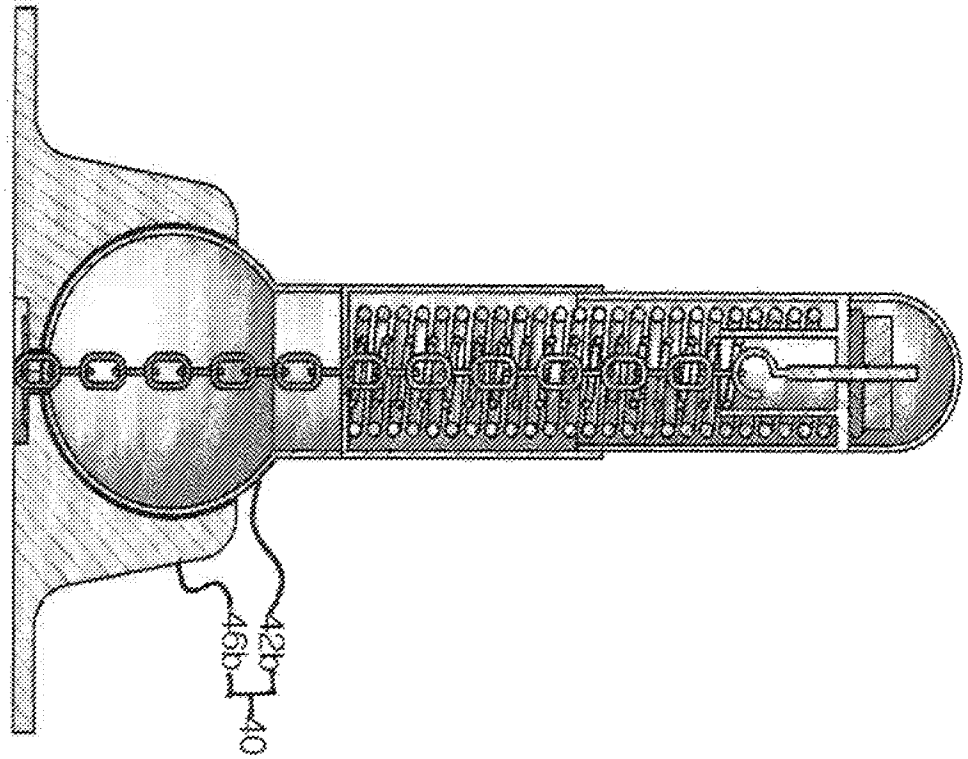
FIG. 10 shows an internal configuration of FIG. 9.
Figure 11:
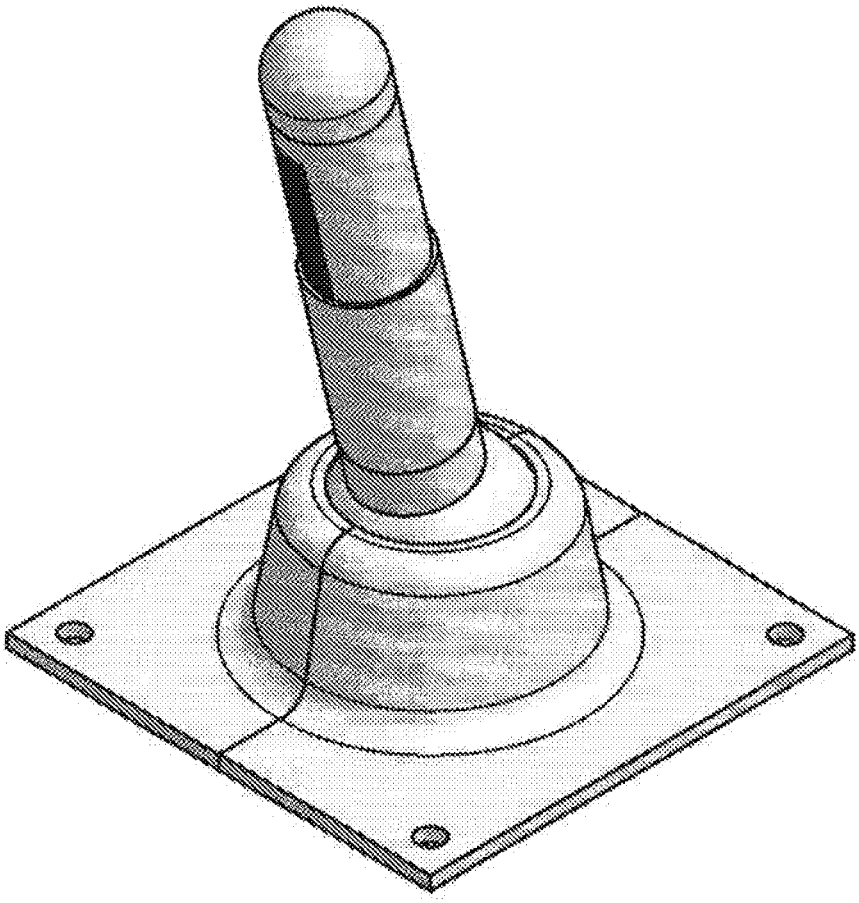
FIG. 11 is a perspective view showing that the lower support consisting of the hinge ball and the ball support is hinge-pivoted.

FIG. 1 is a view showing an example in which a safety fence support device with flexibility is stood and installed on a safety fence in accordance with an embodiment of the present invention. FIG. 2 is a view showing that the safety fence support device with flexibility is installed on a safety fence and is tilted by an external force in accordance with the embodiment of the present invention. FIG. 3 is a side view of FIG. 2. FIG. 4 is a view showing an internal configuration of the safety fence support device with flexibility. FIG. 5 is an exploded view of the safety fence support device with flexibility. FIG. 6 is a perspective view showing that the safety fence support device with flexibility is stood. FIG. 7 is a front view of FIG. 6. FIG. 8 is a view showing that the safety fence support device with flexibility is hinge-pivoted. FIG. 9 is a perspective view showing a lower support consisting of a hinge ball and a ball support. FIG. 10 shows an internal configuration of FIG. 9. FIG. 11 is a perspective view showing that the lower support consisting of the hinge ball and the ball support is hinge-pivoted.

Referring to FIGS. 1 to 8, the safety fence support device with flexibility in accordance with an embodiment of the present invention includes an upper case 10 having a catching portion 12, a protrusion 14, and an indication scale 16 formed therein, a cap 20, a lower case 30, a lower support 40, a first buffer elastic body 50, a second buffer elastic body 60, a locking washer 70, an adjusting nut 80, a screw shaft 90 including a connecting hook 92, a locking pin 95, a connection member 100, and a bracket 110.

The safety fence support device with flexibility according to the embodiment of the present invention is attached in a standing state to a safety fence 2 installed on sports facilities and causes the safety fence to be tilted backward when exercising people collide with the safety fence (hereafter, referred to as an external force), and thus, absorbs impact caused by the external force.

Therefore, the safety fence installed on the sports facilities is not installed in a state of being fixed to the ground and is simply installed and disassembled regardless of the kind thereof. A detailed description of the safety fence itself will be omitted.

First, the operation of the safety fence support device with flexibility according to the embodiment of the present invention will be described with reference to FIGS. 1 to 8.

In FIGS. 1 and 6, when an external force is applied to the safety fence 2 in a standing state, the lower support 40 is pivoted backward about the connection member 100 fixed to the bottom of the lower support 40 in a direction in which the external force is applied to the safety fence 2 (see FIGS. 2, 3 and 8), and absorbs the impact caused by the external force.

Here, referring to FIGS. 4 and 5, a tension is generated in the connection member 100 which connects the connecting hook 92 of the screw shaft 90 with the lower support 40. While the stationary upper case 10 descends by the adjusting nut 80 connected to the screw shaft 90, the first buffer elastic body 50 is pressed.

If a strong external force is applied, the second buffer elastic body 60 is secondarily pressed simultaneously and supports the safety fence, so that the safety fence is prevented from being excessively tilted backward.

When the external force is removed, the first buffer elastic body 50 or both of the first buffer elastic body 50 and the second buffer elastic body 60 is expanded by the support tension of the connection member 100 and by an expansion elastic force generated in the first buffer elastic body 50 or in both of the first buffer elastic body 50 and the second buffer elastic body 60, and then the upper case 10 ascends. Then, the safety fence is hinge-pivoted about the lower support 40 and restores to the standing state.

Hereafter, components according to the embodiment of the present invention will be described in detail with reference to the accompanying drawings.

Referring to FIGS. 4 and 5, the upper case 10 has a pipe shape having an open bottom surface. A through-hole is formed in the center of the closed top surface. The protrusion 14 protrudes downward at a predetermined distance from the center of the top surface such that the catching portion 12 is formed on a circumferential end.

Here, when the upper case 10 descends while the top of the first buffer elastic body 50 contacts the catching portion 12, the catching portion 12 presses the first buffer elastic body 50. When the first buffer elastic body 50 restores to the standing state while being expanded, the upper case 10 ascends.

Also, the protrusion 14 performs a function as a blocking wall which prevents a direct contact between the first buffer elastic body 50 and the second buffer elastic body 60, and functions to guide the second buffer elastic body 60 when the second buffer elastic body 60 is pressed or expanded.

Meanwhile, when the safety fence is tilted backward by the external force applied to the safety fence, the upper case 10 descends while simultaneously pressing the first buffer elastic body 50 and the second buffer elastic body 60 by the tension acting on the below-described connection member 100. When the external force is removed and the safety fence returns to its original standing position by the tension acting on the connection member 100 and the expansive force expanding simultaneously the first buffer elastic body 50 and the second buffer elastic body 60, the upper case 10 ascends.

That is, when the safety fence is tilted by the external force acting on the safety fence, the upper case 10 descends within the lower case 30, and when the external force is removed and the safety fence returns to its original standing position, the upper case 10 ascends.

Also, the indication scale 16 is formed in the longitudinal direction of the upper case 10 on the outer circumferential surface of one side of the upper case 10 which ascends and descends together with the first buffer elastic body 50.

When the first buffer elastic body 50 is fixed after being pressed or expanded by tightening or loosening the adjusting nut 80 for the purpose of adjusting and setting an initial pressing force of the first buffer elastic body 50, the indication scale 16 allows the pressed or expanded length of the first buffer elastic body 50 to be visually checked.

In other words, when the height of the upper case 10 is adjusted and fixed, the scale of the upper case 10, which corresponds to the point where the top end of the lower case 30 is located, is read, so that the pressed or expanded length of the first buffer elastic body 50 can be visually checked.

Since an angle at which the safety fence is hinge-pivoted backward can be adjusted by adjusting the initial pressing force of the first buffer elastic body 50, the absorption amount of the impact caused by the external force can be adjusted.

The cap 20 exposes the upper portion of the upper case 10 in order to tighten or loosen the later-mentioned adjusting nut 80 or closes the upper case 10 in order to prevent rainwater, etc., from being introduced by the external exposure of the screw shaft 90 and the adjusting nut 80.

The lower case 30 has a pipe shape having an open top surface and an open bottom surface. The lower portion of the upper case 10 is inserted within the top surface of the lower case 30.

Referring to FIGS. 4 and 5, the lower support 40 is connected with the bottom surface of the lower case. A through-hole through which the connection member 100 passes is formed in the center of the lower support 40, so that the connection member 100 is fixed to the bottom surface of the lower support 40 by means of a connection pin.

Referring to FIGS. 3 to 5, the lower support 40 includes a lower plate 42 and a plate receiver 46. The lower plate 42 is attached to the bottom surface of the lower case 30 and is hinge-pivoted. The plate receiver 46 receives the lower plate 42 and is fixed to the ground.

The lower plate 42 has a disk shape. A through-hole through which the connection member 100 passes is formed in the center of the lower plate 42. The lower plate 42 absorbs impact caused by the external force applied to the safety fence at various angles, and is hinge-pivoted together with the upper case 10, the lower case 30, and the connection member 100 in the direction of the external force by using the circumferential end of the lower plate 42 as a fulcrum.

Referring to FIG. 5, a through-hole through which the connection member 100 passes is formed in the center of the plate receiver 46. A plate receiving recess 48 receiving the lower plate 42 is formed in the center of the top surface of the plate receiver 46 and limits the movement range of the lower plate. Simultaneously, when the lower plate 42 is hinge-pivoted, the edge of the plate receiving recess 48 contacts the circumferential end of the lower plate 42 and functions as a fulcrum.

Also, a pin groove 44 receiving the locking pin 95 for fixing the connection member 100 is formed in the center of the bottom surface of the plate receiver 46.

The plate receiver 46 is, as shown in FIG. 3, fixed to the ground by a fixing means like a bolt, etc.

Meanwhile, another embodiment of the lower support 40 of the present invention will be described with reference to FIGS. 9 to 11. The lower support 40 may be formed by hinge-coupling a spherical shaped hinge ball **42*b* and a ball support 46*b* receiving the hinge ball. The bottom surface of the ball support 46*b*** is fixed to the ground.

Here, a lubricant, etc., may be added to a contact boundary surface between the hinge ball **42*b* and the ball support 46*b* in order that the hinge ball 42*b* can be smoothly hinge-pivoted within the ball support 46*b***.

Due to the supporting structure by the hinge ball **42*b*, the hinge ball 42*b*** is able to be flexibly hinge-pivoted with respect to the external force applied to the safety fence at various angles, and the impact can be absorbed.

Referring to FIGS. 4 and 5, the first buffer elastic body 50 is inserted within the upper case 10 and is inserted outside the outer circumferential surface of the protrusion 14 of the upper case. The top surface of the first buffer elastic body 50 contacts the bottom surface of the catching portion 12 formed in the upper case 10, and the bottom surface of the first buffer elastic body 50 contacts the top surface of the lower case 30.

When the safety fence is tilted by the external force, the first buffer elastic body 50 is pressed by the descent of the upper case 10 and performs a first impact absorbing function.

Referring to FIGS. 4 and 5, an upper portion of the second buffer elastic body 60 is inserted within the protrusion 14 of the upper case 10. The second buffer elastic body 60 has a length smaller than that of the first buffer elastic body 50. The lower portion of the second buffer elastic body 60 contacts with the lower case 30.

When the first buffer elastic body 50 is pressed by a strong external force applied to the safety fence, the second buffer elastic body 60 performs a second impact absorbing function, lest the safety fence be suddenly tilted backward or fall down at an excessive inclination angle.

That is, when the upper case 10 primarily absorbs the impact by pressing the first buffer elastic body 50 while descending by the external force and then further descends by the excessive external force, the upper case 10 presses the first buffer elastic body 50 and the second buffer elastic body 60 at the same time. Here, the tension of the connection member 100 and the expansion repulsive force of the first buffer elastic body 50 and the second buffer elastic body 60 simultaneously act on the upper case 10, so that the safety fence can be prevented from being excessively tilted backward or from being damaged.

Meanwhile, when the external force is removed, the tension of the connection member 100 and the expansion repulsive force of each buffer elastic body act, so that the safety fence returns to its original standing position.

Also, the second buffer elastic body 60 prepares for a case where the first buffer elastic body 50 cannot sufficiently absorb the impact. Therefore, it is desirable that there is an appropriate difference between the length of the second buffer elastic body 60 and the length of the first buffer elastic body 50 in consideration of the strength and direction of the external force applied to the safety fence.

For example, regarding the safety fence installed on a ski slope, an external force is applied mainly obliquely to the safety fence at an inclination angle rather than perpendicular to the safety fence. Therefore, in this case, it is desirable that only the first buffer elastic body absorbs the impact by increasing the length difference between the first buffer elastic body and the second buffer elastic body.

The locking washer 70 is connected to the top surface of the upper case 10 and improves a coupling force between the adjusting nut and the upper case.

The adjusting nut 80 is connected to the top surface of the locking washer 70 and is inserted into the outer circumference of the screw shaft 90 so as to adjust the initial pressing force of the first buffer elastic body 50. When the adjusting nut 80 is tightened downward, the upper case 10 presses the first buffer elastic body 50 while descending, and thus, gives an initial pressing force. When the adjusting nut 80 is loosened backward, the upper case 10 ascends and the first buffer elastic body 50 is expanded, so that the pressing force can be adjusted.

The adjusting nut 80 is fastened to the under screw shaft 90 and presses down the standing upper case 10, and then gives an pressing force to the first buffer elastic body 50, so that the upper case 10 is fixed to a certain position.

In a case where the upper case 10 descends by tightening the adjusting nut 80 and a strong initial pressing force is applied to the first buffer elastic body 50, when a stronger expansion repulsive force acts. Therefore, when the safety fence is tilted by the external force, a tilt angle with respect to the lower support 40 can be reduced. Also, a distance between the second buffer elastic body 60 and the lower support 40 is reduced. Therefore, when the safety fence is tilted backward by the external force, the upper case 10 presses the second buffer elastic body 60 more quickly. Accordingly, when a large external force is applied to the safety fence, the safety fence is able to effectively absorb the impact caused by the external force and to quickly restore to the standing state.

Meanwhile, when the adjusting nut 80 is loosened backward and the first buffer elastic body 50 is expanded, operations opposite to the foregoing description are performed.

Therefore, the adjusting nut 80 adjusts the pressing force, so that the safety fence is able to flexibly react to the various external forces including a large external force, a small external force, etc.

Referring to FIGS. 4 and 5, the screw shaft 90 includes the connecting hook 92 at the lower end thereof and is provided to pass through the centers of the upper case 10, the locking washer 70, and the adjusting nut 80. The screw shaft 90 acts together with the adjusting nut 80 and adjusts and sets the initial pressing force of the first buffer elastic body 50.

The connection member 100 is (see FIGS. 4 and 5) located within the second buffer elastic body 60. One end of the connection member 100 is connected to the connecting hook 92 of the screw shaft 90 and the other end is connected and fixed to the locking pin 95 of the bottom surface of the lower support 40.

The connection member 100 is installed such that a tension having a certain magnitude always acts on the connection member 100. When the external force is applied to the safety fence, the connection member 100 supports and prevents the safety fence from being excessively tilted backward. When the external force is removed, the connection member 100 applies an elastic force with respect to an expansive force expanding the first buffer elastic body 50 or the first and the second buffer elastic bodies 50 and 60, so that the safety fence has a property of restoring its original state.

Meanwhile, although the metallic chain-shaped connection member 100 is used in the embodiment of the present invention, the material and shape of the connection member are not limited to this. Any connection member capable of connecting the screw shaft 90 with the lower support 40 by means of a strong tension can be used.

Referring to FIGS. 1 to 3, the bracket 110 forms a space between the lower case 30 and the safety fence 2, and connects and fixes the lower case 30 to the rear of the safety fence. It is desirable that the bracket 110 is installed on the lower case 30 and on the rear of the safety fence 2 with a certain space formed between the support device and the safety fence in order that the bracket 110 is not obstructive to the ascent and descent of the upper case 10 and to the hinge-pivoting of the support device.

When the safety fence has a certain width and volume, the support device of the present invention may be received and installed within the safety fence without using the bracket.

Meanwhile, the bracket 110 connecting the safety fence shown in FIGS. 1 and 2 with the support device according to the embodiment of the present invention is only an example. Since the shape of the bracket and how to connect the safety fence 2 with the lower case are not limited to this, it is also possible to use a variety of connecting devices which securely connect the safety fence with the support device and do not affect the hinge-pivoting of the support device.

Meanwhile, according to another embodiment of the support device of the present invention, in order to support advertising media including a signboard which is installed to protrude from the outer wall of a building, the support device according to the embodiment of the present invention is installed on the inside or both ends of the signboard, etc., and flexibly supports the advertising media even in external environments like wind, etc.

The foregoing is only an illustrative description of the spirit of the present invention. Various substitutions, modification and changes may be made therein without departing from the essential features of the present invention by those skilled in the art. Therefore, the embodiments and accompanying drawings of the present invention are not intended for limiting the spirit but intended for describing the spirit of the present invention, and the spirit and scope of the present invention are not limited by the embodiments and accompanying drawings. The scope of the present invention should be construed by the appended claims. All the spirits within the scope equivalent to the claims should be construed to be included in the right scope of the present invention.

| [Reference Numerals] | |
|---|---|
| 2: safety fence | 10: upper case |
| 12: catching portion | 14: protrusion |
| 16: indication scale | 20: cap |
| 30: lower case | 40: lower support |
| 42: lower plate | 46: plate receiver |
| 50: first buffer elastic body | 60: second buffer elastic body |
| 70: locking washer | 80: adjusting nut |
| 90: screw shaft | 92: connecting hook |
| 95: locking pin | 100: connection member |

What is claimed is:

1. A safety fence support device with flexibility, the support device comprising:

a pipe-shaped uppercase which has a top surface, a through-hole formed in the center of the top surface, a catching portion formed on a circumferential end of the top surface, a pipe-shaped protrusion extending vertically downward at a predetermined distance from the center of the top surface, and an open bottom surface;

a cap which opens and closes the upper case;

a pipe-shaped lower case which has an open top surface and an open bottom surface, wherein a lower portion of the upper case is inserted within the open top surface;

a lower support which is attached to the bottom surface of the lower case and is fixed to the ground;

a first buffer elastic body which is inserted within the upper case, is inserted outside an outer circumferential surface of the protrusion of the upper case, has a top surface contacting the catching portion formed in the upper case, and has a bottom surface contacting a top surface of the lower support;

a second buffer elastic body which has a length smaller than that of the first buffer elastic body, is located within the first buffer elastic body, has an upper portion inserted within the protrusion of the upper case, and has a lower portion contacting the top surface of the lower support;

a locking washer which is attached to the top surface of the upper case;

an adjusting nut which is attached to a top surface of the locking washer and adjusts an initial pressing force of the first buffer elastic body;

a screw shaft which has a connecting hook at a lower end thereof, is provided to pass through the centers of the upper case, the locking washer, and the adjusting nut, transfers the adjusting nut, and adjusts and sets the initial pressing force of the first buffer elastic body; and a connection member which is located within the second buffer elastic body, has one end connected to the connecting hook of the screw shaft, and has the other end fixed to a locking pin of a bottom surface of the lower support.

2. The safety fence support device with flexibility of claim 1, wherein the lower support comprises:

a lower plate which is attached to the bottom surface of the lower case, has a through-hole formed in the center thereof, wherein the connection member passes through the through-hole, absorbs impact caused by an external force applied to the safety fence at various angles, and is hinge-pivoted together with the upper case, the lower case, and the connection member in a direction of the external force by using a circumferential end thereof as a fulcrum; and a plate receiver which has a through-hole formed in the center thereof, wherein the connection member passes through the through-hole, has a plate receiving recess formed in the center of a top surface thereof, wherein the plate receiving recess receives the lower plate, has a pin groove formed in the center of a bottom surface thereof, wherein the pin groove fixes the connection member, and is fixed to the ground.

3. The safety fence support device with flexibility of claim 1, further comprising an indication scale formed in a longitudinal direction of the upper case on an outer circumferential surface of one side of the upper case which ascends and descends together with the first buffer elastic body, in order that a pressed or expanded length of the first buffer elastic body is visually checked when the first buffer elastic body is pressed or expanded by tightening or loosening the adjusting nut for the purpose of adjusting and setting the initial pressing force of the first buffer elastic body.

* * * * *